United States Patent [19]

Hentz et al.

[11] 4,060,377

[45] Nov. 29, 1977

[54] TEMPERATURE MONITORING FURNACE

[75] Inventors: LeRoy Richard Hentz, Hyde Park; Gary Frank Pavlovic, Beacon; Angelo James Scarafino, Wappingers Falls; John Joseph Seksinsky, Poughkeepsie, all of N.Y.

[73] Assignee: International Business Machines Corporation, Armonk, N.Y.

[21] Appl. No.: 695,603

[22] Filed: June 14, 1976

[51] Int. Cl.[2] ..... F27D 19/00

[52] U.S. Cl. ..... 432/50; 73/340; 236/15 BF; 432/206

[58] Field of Search ..... 432/50, 206, 210, 36, 432/50; 73/340, 339 R; 236/15 BF

[56] References Cited

U.S. PATENT DOCUMENTS

| | | | |
|---|---|---|---|
| 2,788,958 | 4/1957 | Tilden | 432/36 |
| 2,954,457 | 9/1960 | Whitehead, Jr. | 73/340 |
| 3,582,054 | 6/1971 | Beck | 432/50 |
| 3,628,777 | 12/1971 | Lavender | 432/50 |
| 3,658,309 | 4/1972 | Lavender | 432/50 |
| 3,732,066 | 5/1973 | Kipple et al. | 432/50 |

*Primary Examiner*—John J. Camby
*Attorney, Agent, or Firm*—Edward W. Brown; William J. Dick

[57] ABSTRACT

Apparatus for monitoring product temperature in a furnace, the furnace being of the open ended and secondary emission type, and having a plurality of serially arranged heating zones therein, each of the zones being adjustably heated. The furnace includes a conveyor which passes therethrough for carrying product thereon through the furnace. As is conventional, the furnace includes an outer casing or wall and an inner muffle with a cavity therebetween. Heaters are provided for applying heat to the cavity to heat the wall of the muffle. Tubes are provided for passing through the casing and into the muffle so that temperature sensing means may pass through the tubes into the muffle superimposed of the conveyor. The temperature sensors are connected to a monitoring system for amplification and for monitoring the temperatures directly of at least the critical zones of the furnace so that adjustment of the temperature may be made within preselected zones without causing loss of product.

8 Claims, 4 Drawing Figures

TEMPERATURE MONITORING FURNACE

SUMMARY OF THE INVENTION AND STATE OF THE PRIOR ART

The present invention relates to a specially equipped furnace for monitoring product temperature in the furnace, and more particularly relates to a furnace having facilities for monitoring product temperature in which the furnace is open ended, is of the secondary emission type, includes a plurality of serially arranged heating zones therein and a conveyor which passes therethrough for carrying product thereon through the furnace, the temperature sensors being located and positioned to permit adjustment of the temperature in the various zones of the furnace.

In the manufacture of gas panels (gaseous discharge display panels) there are numerous process steps which are deemed critical to the final acceptable operation of the panel. Typically in the manufacture of AC type panels, a pair of glass plates are processed first by placing a layer of chromium-copper-chromium on one major surface of each of the plates, and then by suitable photo-resist techniques well known in the semiconductor art, the metal is etched to form conductive lines on the plates, the lines on one of the plates being orthogonal to the lines on the other of the plates when they are mated together. After suitable cleaning operations, the surfaces of the plates are covered with a passivating layer, for example, a glass frit, which is then reflowed in a furnace, and which is followed by the laying down of a layer of magnesium oxide. Spacer rods are then placed on the bottom plate along with outboard seal rods along the periphery of the bottom plate, the plates are placed together then passed through a seal furnace. The seal rods have a lower melting temperature than the smaller diameter spacer rods so that upon the product and the furnace reaching a suitable temperature the sealing rods melt allowing the upper plate to drop down onto the spacer rods thereby forming a pocket or cavity between the two plates which are now sealed around their periphery. The sealing temperature of the rods are critical and must be controlled within very narrow limits. For example, the window for the seal for the type utilized in patent application, Ser. No. 572,036, filed on Apr. 28, 1975, now U.S. Pat. No. 3,982,918, should be between 478° to 492° C. If the seal rod does not attain at least 478° C an improper seal will be made, while if the temperature exceeds 492° C, crazing of the passivating layers will occur. Accordingly, it is imperative that the temperature of the furnace in which the sealing occurs be very accurately controlled.

After a proper cooling off period, the panel is placed in another furnace, a vacuum drawn on a nipple attached to the rear panel, and the panel is permitted to bake under controlled conditions to effect outgassing thereof. The cavity is then filled with a neon-argon mixture and a resistance type heater element around the nipple effects seal off.

Conventionally open ended furnaces having separate heating zones in which a conveyor passes through for carrying product has permitted of temperature control of the various zones in the furnace and has permitted of temperature monitoring of the temperature of the muffle by placing temperature sensors externally of the furnace muffle but interiorly of the furnace casing. However, with product in which the temperature must be controlled within very narrow limits, it is mandatory that the furnace be temperature profiled very accurately to prevent exceeding both an upper and lower limit such as outlined above with respect to the manufacture of gas panels. In practice, and heretofore, this was accomplished by placing dummy product on the conveyor, permitting the conveyor to carry the dummy product with a thermocouple attached through the furnace and monitoring at intervals the temperature of the product as it passed through the furnace. Adjustments then were made to each of the required zones and then another dummy product was run through the furnace, again with a thermocouple attached and further adjustments were made. In many instances the procedure would require four to five days and sometimes even as long as two weeks to properly profile the furnace so that the product would reach the required "window" of temperature within the furnace.

The problem of precise zone control is aggravated when the furnace is located within a room which contains facilities for maintaining a clean atmosphere (e.g., class 100 or better. Constant air circulation entering the open ends of the furnace obviously creates drafts which effect the temperature of at least some of the zones.

With the apparatus of the present invention, furnaces of the secondary emission type having a plurality of serially arranged heating zones may be brought to their temperature precisely within a matter of hours as opposed to days, and may be maintained in a clean atmosphere without overreactions in temperature gradients due to drafts.

There are numerous prior art references which extol the virtues of being able to monitor the temperature of the workpiece as it passes through a furnace or as it resides in a closed end type furnace. The principal teaching of the prior art, however, is to view the work product in the furnace through glass ports or the like as by pyrometers, for example, as taught in the Rau et al Pat. No. 3,810,743, or have retractable temperature measurement probes such as taught in the Waziri Pat. No. 3,247,364. However, none of the prior art seems to recognize the importance, in open ended secondary emission type furnaces, of being able to place the temperature sensors close to the product while sealing the internal muffle of the furnace from the heating elements themselves to prevent drafts or the like from effecting product temperature. This is especially critical in areas which employ clean air type rooms for insuring product cleanliness into and out of the furnace but wherein the remainder of the furnace, for example, the sidewall casings, are located in service corridors which are not equipped with class 100 air (or better) which can effect contamination of the interior of the furnace if the furnace ports are left open for any length of time.

In view of the above, it is a principal object of the present invention to provide for product temperature monitoring in secondary emission type heating furnaces having serially arranged zones therein and wherein the furnace includes a conveyor which passes therethrough for carrying product thereon, so that the temperature of the heating zones may be correctly brought to their proper operating temperatures within very short periods of time.

Yet another object of the present invention is to provide a simple yet effective temperature monitoring probe system for furnaces which permit of accurate temperature monitoring within the furnace muffle without escape of gaseous medium either from the furnace muffle or into the furnace muffle from the secondary emission heating zone of the furnace.

Still another object of the present invention is to provide temperature monitoring within the muffle of an open ended furnace which permits of precise zone temperature control even with the furnace is in a clean room atmosphere.

Other objects and a more complete understanding of the invention may be had by referring to the following specification and claims taken in conjunction with the accompanying drawings in which:

Figure 1:
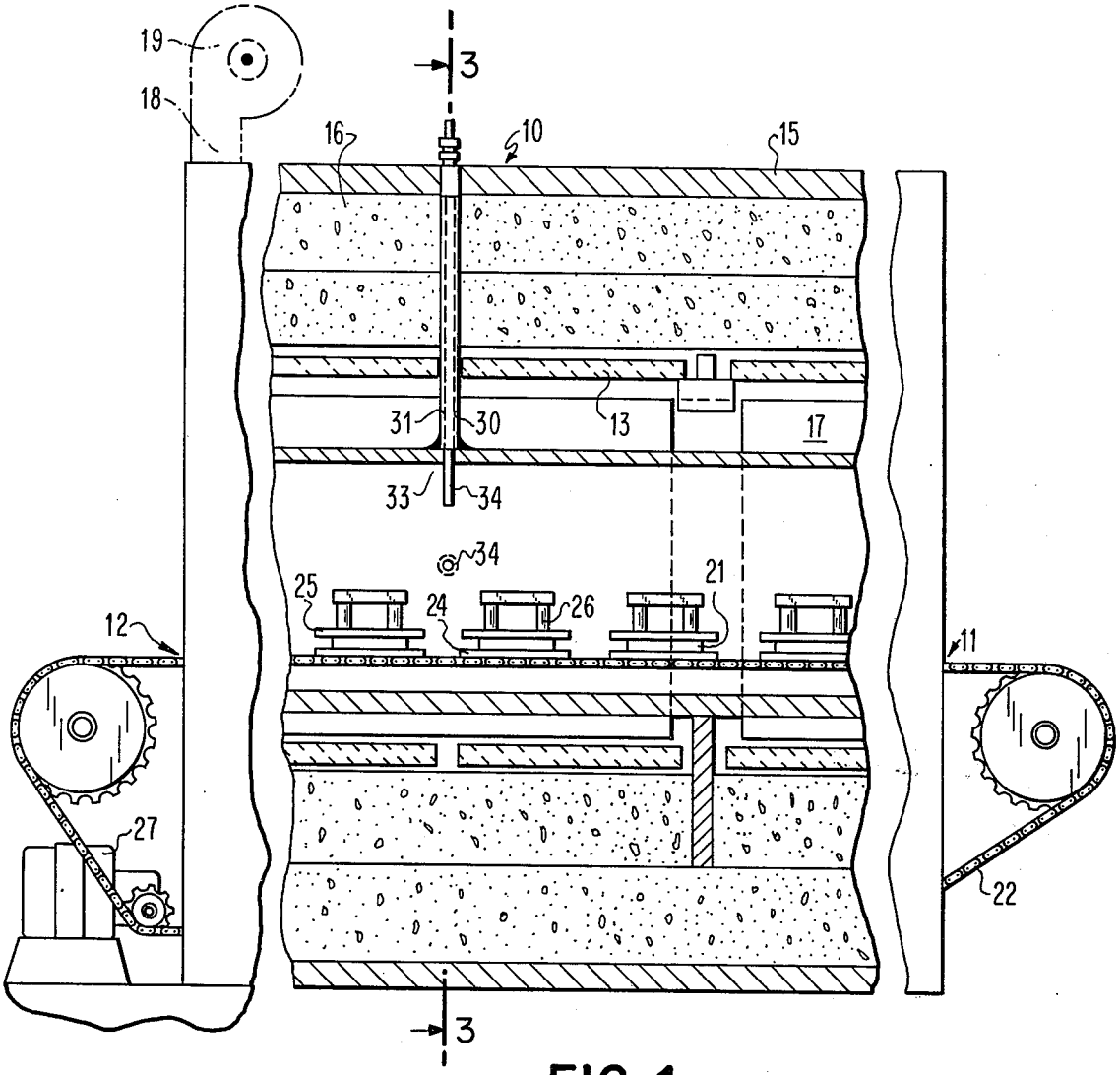
FIG. 1 is a fragmentary side elevational view of a typical furnace incorporating the apparatus of the present invention.

Turning now to the drawings, and especially FIG. 1 thereof, a typical 14 zone furnace 10 such as manufactured by B.T.U. or Watkins-Johnson is illustrated therein. As shown, the furnace has an open inlet 11 and outlet end 12 and contains a plurality of serially arranged heating zones therein, there being separate heater elements 13 in each zone so as to make the temperature in each zone adjustable even though adjacent zones are in communication with each other. As illustrated best in the cross section shown in FIG. 3, the furnace contains an outer casing 15, adjacent insulating fire brick 16 which forms a cavity 17 in the central portion of the casing. Heater elements 13 may also be mounted in the exhaust plenums 18 of blowers 19, the exhaust plenums 18, illustrated in FIG. 1, being connected to the cavity 17 associated with a particular zone. Mounted interiorly of the cavity 17 and extending longitudinally of the furnace is a conventional furnace muffle 20 which receives heat from the heaters (in the illustrated instance electrical heaters) and which heats the product 21 carried on a conveyor, in the illustrated instance, a pair of conveyors 22 and 23 respectively. In the illustrated instance, the panels 21 are located intermediate a platen 24 and a flat cover plate 25 on which a weight 26 is mounted to aid in the sealing process described heretofore.

As shown best in FIG. 1, the conveyors 22 and 23 pass through the furnace 10 to permit loading of product 21 at one end and unloading of product from the other end. The conveyor, as illustrated, has drive means 27 which permit adjustment of the speed of the conveyor to permit adjustment of resident time of product in the furnace. Additionally, and as is conventional on furnaces of this type, a control panel 28 (FIG. 2) includes separate controls for each of the zones, for example, when the furnace is heated electrically (as shown), the furnace controls may be comprised of rheostats.

Figure 3:
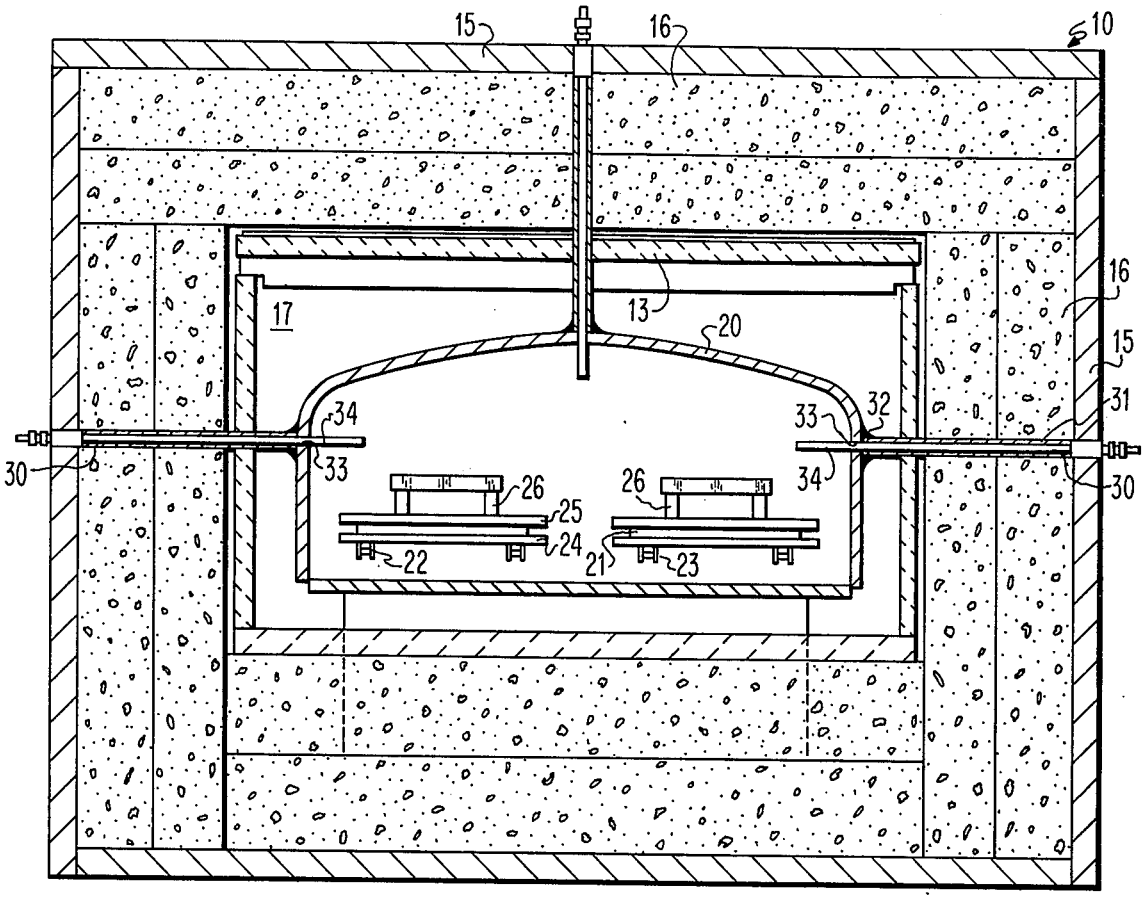
FIG. 3 is an enlarged sectional view taken along line 3—3 of FIG. 1.
Figure 4:
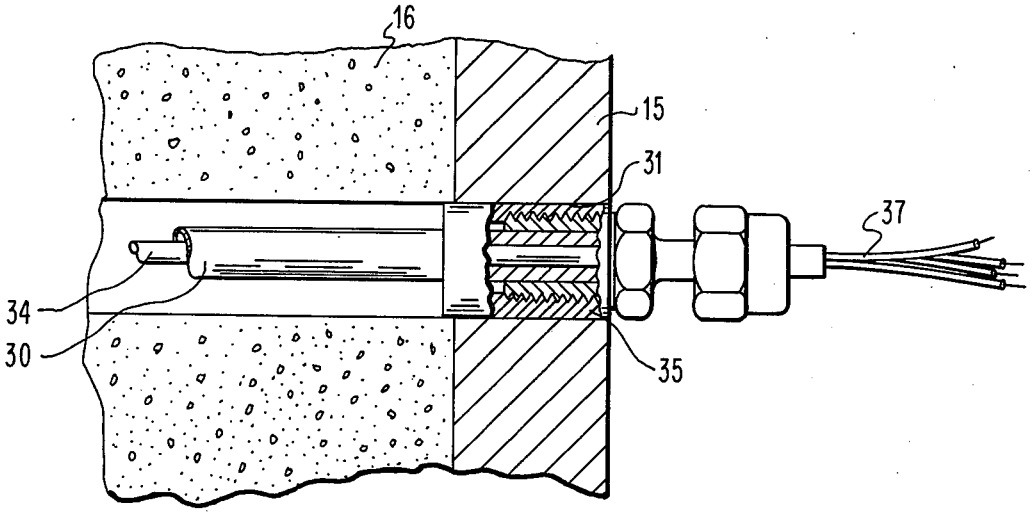
FIG. 4 is an enlarged fragmentary sectional view of a typical temperature sensor in place through the furnace wall or casing and constructed in accordance with the present invention.

In accordance with the invention, means are provided for passing temperature sensor holders into the muffle through the side and top casing walls of the furnace while retaining the temperature sensors in a position superimposed of the product as it passes through the muffle and without permitting either the escape of gasses interiorly of the furnace to the outer part of the casing and the passage therethrough of external atmosphere of the furnace into the muffle area through the holder. To this end, and as best shown in FIGS. 1, 3 and 4, the temperature sensor holder comprises a sleeve or tube 30 which passes through an aperture or hole 31 in the casing 15 and fire brick or insulation 16. The sleeve or tube 30 also passes through the cavity 17 and is joined as by sealing means, in the illustrated instance, a weld 32, to the muffle 20. The weld is such as to prevent gases in the cavity 17 from entering into the muffle 20 and is necessary to inhibit contamination of the product 21 carried therein. An aperture 33 in the wall of the muffle is axially aligned with the bore of the tube 30 and permits entry into the tube of the temperature sensor element 34, the bore 31 being sealed at the end of the tube or sleve 30 as by a compression fitting 35 which expands to prevent hot gasses from the cavity 17 from escaping from the furnace.

The compression fitting is of a standard type, for example, a series 79 Rosemount compression fitting sold by Rosemount Inc., Minneapolis, Minn. The temperature sensors 34 on the other hand may be of the resistance type such as the series 78 single element platinum resistance temperature sensor again made by Rosemount, or may be a thermocouple design such as sold by Omega Engineering in Stamford, Conn. Obviously several other commercially available sensors and fittings would suffice to seal the casing and the muffle to prevent gaseous media entry into or out of the muffle by way of the bore 31.

As shown best in FIG. 3, the sensors 34 are preferably located superimposed of the product carried on the conveyor and while a single sensor may be sufficient for certain product, multiple sensors located such as illustrated in FIG. 3 will give a temperature profile in cross section of the furnace at each of the zones so that separate zones may be adjusted precisely for the very limited temperature windows required for critical product processing.

The wire leads 37 (FIG. 4) emanating from the sensor 34 may be connected to a small signal amplifier means 38 (FIG. 2) which may be connected in a conventional manner to a chart recorder, analog readout, etc. The amplifier 38 may be a Rosemount temperature transmitter, a Leeds and Northrup amplifier or transmitter, either of which sends an analog signal to either a recorder, or direct reading instrument as above described or to a digital readout system or display to indicate temperature in a particular zone directly.

Figure 2:
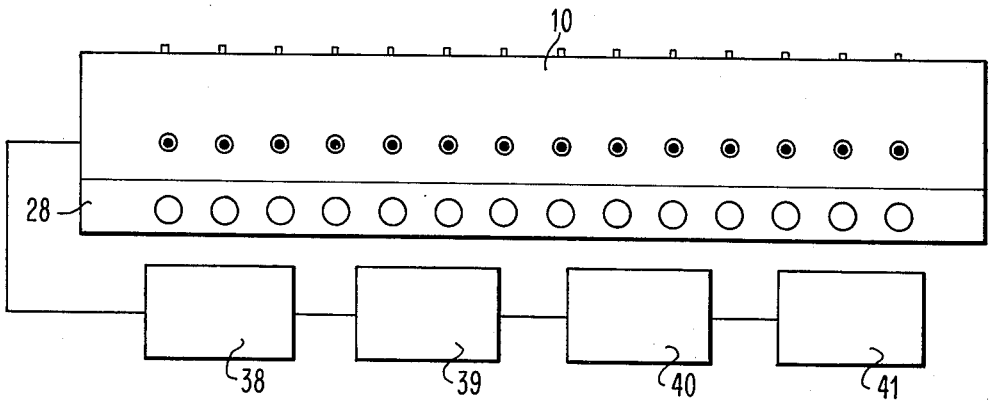
FIG. 2 is a schematic diagram of a typical set-up for monitoring the temperatures in the various zones of the furnace.

As shown in FIG. 2, while the various controls for the heater elements may be controlled manually to give the proper operating temperature within the muffle so as to determine accurately the temperature of the product 21 as it passes through the muffle on the conveyor, the monitoring means 38 may be directly connected to a distributive interface such as disclosed in patent application, Ser. No. 673,011, filed on Apr. 2, 1976, the pertinent parts of which are herein incorporated by reference. In turn, the distributive interface 39 (FIG. 2) may be connected to a computer 40 such as an IBM System 7 which compares through suitable programming the temperature actually received from the temperature control monitor in the various zones of the furnace with an ideal temperature profile for the furnace. Any differences from the actual reading verses that which it should be may suitably be displayed on a graphic terminal 41 such as a Textronixs model #4015. If the temperature of one or more zones is out of the desired range, then the operator may make suitable adjustments as through the various control rheostats 28. Additionally, if the temperture sensors indicate that a particular critical zone has overheated, to save product within the furnace, the conveyor speed may be adjusted by the operator to limit the resident time of the product within the furnace.

To inhibit the effect of thermal expansion and contraction of the tubes relative to the muffle, it is preferable that the tubes be composed of the same material as the muffle, for example, Inconnel.

It should be recognized that the temperature sensors 34 may be used to correct or maintain existing situations within the furnace as product is passing therethrough, and the proximity of other temperature sensors within the muffle in any given zone will act as a check for the other sensors. Additionally, standard sensors may be employed to insure the accuracy of the temperature sensors merely by loosening the compression fitting, withdrawing the sensor in place and inserting the standard so that the accuracy of the temperature sensors in any one particular zone may be accurately checked.

Although the invention has been described with a certain degree of particularity, it is understood that the present disclosure has been made only by way of example and that numerous changes in the details of construction and the combination and arrangement of parts and the mode of operation may be made without departing from the spirit and the scope of the invention is hereinafter claimed.

What is claimed is:

1. Apparatus for monitoring product temperature in a furnace; comprising in combination: an open ended furnace of the secondary emission type having a plurality of serially arranged heating zones therein, said furnace having an outer casing and an inner muffle with a cavity therebetween, means for applying heat to said cavity in each of said zones to heat said muffle, and at least one conveyor passing through said muffle for carrying product thereon through said furnace; open ended tubes passing through said casing into said muffle and attached thereto; and temperature sensing means passing through at least some of said tubes, into said muffle, and superimposed of said conveyor so that one end is positioned in direct communication with the gaseous medium in the muffle; and means to seal said tubes at said casing and said muffle to inhibit gaseous medium communication between said muffle and externally of said casing.

2. Apparatus in accordance with claim 1 wherein each of said tubes at one terminal end thereof, is welded to said muffle, and includes a fitting to seal said tube in said casing at said opposite end.

3. Apparatus in accordance with claim 2 wherein said fitting comprises a compression fitting.

4. Apparatus in accordance with claim 2 including means for monitoring the temperature indicated by said temperature sensing means to thereby permit adjustment of temperature within preselected zones.

5. Apparatus in accordance with claim 4 wherein said furnace includes at least one tube in each of said zones.

6. Apparatus in accordance with claim 1 including at least a pair of tubes in each of said zones.

7. Apparatus in accordance with claim 1 wherein said tubes are arranged in pairs connected to opposite sides of said muffle and in the same plane.

8. Apparatus in accordance with claim 7 wherein said tubes are located in each of said zones.

* * * * *